United States Patent [19]

Scheid

[11] 4,209,954

[45] Jul. 1, 1980

[54] PANEL CONSTRUCTION HAVING LATERAL EDGE MEMBERS

[76] Inventor: Lloyd J. Scheid, 4404 Grimes Pl., Encino, Calif. 91316

[21] Appl. No.: 857,126

[22] Filed: Dec. 5, 1977

[51] Int. Cl.[2] ..... E04C 2/04

[52] U.S. Cl. ..... 52/601; 52/366

[58] Field of Search ..... 52/613, 615, 601, 416, 52/417, 418, 371, 372, 364, 366, 367, 255, 288, 415, 447, 434; 428/192, 70; 156/39, 40, 42

[56] References Cited

U.S. PATENT DOCUMENTS

| | | | |
|---|---|---|---|
| 2,200,750 | 5/1940 | Kenney | 52/483 |
| 3,255,561 | 6/1966 | Cable | 52/255 |
| 3,307,313 | 3/1967 | Tatum | 52/366 |
| 3,708,935 | 1/1973 | Kossuth | 52/416 |
| 4,047,347 | 4/1977 | Scheid | 52/612 |

FOREIGN PATENT DOCUMENTS

| | | | |
|---|---|---|---|
| 25280 | 7/1952 | Finland | 52/601 |

*Primary Examiner*—John E. Murtagh
*Attorney, Agent, or Firm*—Cislo & O'Reilly

[57] ABSTRACT

A wall panel construction comprising prefinished wall panels of fire resistive material, such as gypsum board, wherein the opposed vertical edges have secured thereto lateral edge members of particular configuration. Initially, the lateral edge members have a flaring configuration exteriorly of the plane of the finished surface of said panels, wherein a filler is applied to provide about planar continuity between the outwardly flaring surface of the lateral edge member and the eventually finished surface of the panel member. Thereafter, finishing by sanding and squaring produces a trued panel to which is applied to decorative coating to produce a finished panel member. Texturized paint or wall covering may be laminated or adhesively secured to the entire exposed finished surface of the panel. Unsecured flaps of the wall covering may also be provided. In either case, because of the trueness of the lateral edges thusly formed in the panels, like panels, which may be secured to supporting structure such as studs, in side-by-side abutting relationship form almost perfect abutment seams, which are barely discernible upon visual inspection. The thusly formed wall construction utilizing a plurality of the disclosed invention panels provides a fire resistive, Class A, fire-rated wall, which is particularly adaptable for mobile home construction and other interior wall construction, wherein ease of fabrication and erection of the panels, into the finished wall are easily and economically obtained.

1 Claim, 8 Drawing Figures

PANEL CONSTRUCTION HAVING LATERAL EDGE MEMBERS

BACKGROUND OF THE INVENTION

This invention pertains to wall panel construction where the wall panels utilize fire resistive construction such as gypsum board and other fire resistive materials, wherein the core of the panels is comprised of said gypsum boards and wherein the vertical edges of the panels are provided with elongate edge members of a specific configuration and wherein, the one surface adapted to be exteriorly presented in a wall construction, is predecorated or finished at the factory site to thereby provide a prefabricated-type of wall panel, which is easily erected to finish off the interior of a room. Alternately, the panels of the invention may be utilized to form other interior wall surfaces of relatively low cost requiring little, if any, sophisticated carpentry skills. The panels of the present invention have unique and specific applicability to factory prefabricated homes conventionally referred to in the trade as mobile homes.

Continuing inflationary pressures in the housing industries have created a demand for prefinished or prefabricated building components, which are not only economically feasible, but also usable by workmen of general as opposed to specialized skills. Additionally, because of the ever increasing concern with ultimate consumers by governmental agencies, building components such as prefabricated panels for erection to interior walls must meet certain minimum fire standards. The achievement of an aesthetically pleasing prefabricated or prefinished wall panel which is easily erectable into a finished wall, with relative ease and at relatively low cost, while still being capable of meeting stringent fire code requirements, is the primary object of this invention.

The utilization of generally available materials, for example, such as gypsum board and adaptation thereof to a specific specialized use to achieve end results as heretofore alluded to is, of course, an important factor in maintaining economical alternatives that still meet the needs of the building industry. Thus, in the present invention, conventional gypsum board is modified, by having applied thereto lateral edges intended to be put into substantial vertical disposition. Wood edge members extend the length of the gypsum board lateral edges and are adhesively secured thereto, as by a hot seal process. One surface of the wood edge members is substantially coplanar with the one surface of the gypsum board intended to be concealed, whereas the opposed surface of the lateral wood edge is outwardly flaring and spackle filler or other material is filled in to make that surface substantially continuous with the opposed gypsum board surface adapted to be exteriorly exposed. Thereafter, a sanding process removes a portion of the filler and flared portion of the wood edge member to provide a substantially planar surface to which a decorative wall covering (paint or vinyl) is applied to the one surface of the gypsum board, remaining spackle or filler and wood edge surfaces. The prepared panel edges are then subjected to a sawing or cutting operation to ensure the absolute trueness of the opposed lateral edges to within specific tolerances to thereby ensure that, when like panels are placed in side-by-side abutting relationship, the seam formed thereby is barely discernible on visual inspection. In one embodiment the panels are nailed to supporting stud structure through the lateral edge members and thereafter the nail holes may be filled with the same type of decorative coating or covering making up the exterior aesthetic finish. In another embodiment, a vinyl wall covering is provided having unattached flaps at the edges, which are later glued over once the panel has been secured to its underlying support structure.

OBJECTS AND SUMMARY OF THE INVENTION

It is an object of the invention to provide a panel construction for interior walls.

It is another object of the invention to provide a prefinished, prefabricated panel construction for easy erection into interior walls.

It is still another, more important and specific object of the invention to provide prefinished panel members for construction into interior walls having, at least, Class A fire-rating.

It is still another, more specific and even more important object of the invention to provide a prefabricated wall panel which is easily erectable with ordinarily skilled labor into interior walls of aesthetic appearance, having fire resistive characteristics.

It is still another, more specific important object of the invention to provide wall panel members utilizing a gypsum core member, which is modified by having lateral edge members applied to opposed lateral edges thereof so that when like panels are placed in side-by-side abutting relationship, a close tolerance fit is obtained, which, upon completion of the wall, is barely discernible to the visual observer.

It is another, still more important specific object of the invention to provide a fire resistive panel member for erection into an interior wall for use in prefabricated homes and the like wherein the panels are predecorated and/or finished at the factory site.

In an exemplary embodiment the invention is directed to a panel construction for interior walls comprising a gypsum core member having opposed lateral edges intended for about vertical disposition to form a portion of an interior wall. The core member has opposed planar surfaces, one of said surfaces being adapted to be aesthetically and exteriorly finished, the other being unfinished. An elongate edge member is secured to each of the opposed lateral edges and extend about the extent thereof and has one surface having about planar continuity with the intended unfinished surface of said gypsum core member while the other surface flares outwardly and exteriorly of the plane of the intended aesthetically and exteriorly finished surface. The lateral edge members are of sufficient width to accommodate a securement means therethrough. A layer of filler extends from the flared edge of said elongate edge members and is feathered to fill in and provide about planar continuity between said one of said surfaces intended to be aesthetically and exteriorly finished and the flared, outwardly, exteriorly directed surface of said elongate edge member. The flared and filled in surface of the lateral edge member, as well as a portion of the filler layer is sanded to the point of forming an almost continuous planar surface at and adjacent to said lateral edges. To finish the panel member, a decorative surface is applied on said one of said surfaces being intended to be aesthetically and exteriorly finished.

These and other objects of the invention will become apparent from the figures of drawing and the hereinafter following commentary.

Figure 1:
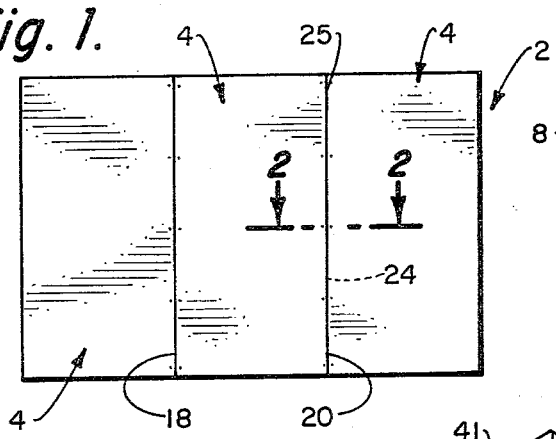
FIG. 1 is an elevational view of panel construction of the invention forming an interior fire resistive wall.

DESCRIPTION OF THE BEST EMBODIMENT CONTEMPLATED:

Referring to the drawings wherein like numerals of reference designate like elements throughout, it will be seen that a wall 2 is formed by individual wall panels 4 secured in side-by-side abutting relationship to underlying support structure such as wood, for example, stud 6.

The individual panels 4 are prefinished or fabricated at a factory site and are erectable on the job site. Each of the individual panels 4 comprise a conventional gypsum core 8 having a first surface 10 formed of paper layer 12 and second opposed surface 14 with paper layer 16. The gypsum core member 8 will typically be about 4'×8' in size but those of ordinary skill in the art will at once recognize that the attributes of the invention may be applied to gypsum cores of various sizes.

In some instances, for better handling, the paper layer 12 may terminate short of the lateral edges 18 and 20 by about ¼". This insures better handling of the panel 4 and also provides a means whereby, if necessary, the surface 30 of the lateral edge members 26 may be subjected to a sawing or planing operation to ensure substantial coplanarity between the applied lateral edge member 26 and the adjacent surface of gypsum core 8. Where possible, the gypsum panels are provided in true, squared form (small tolerances being necessary) with lateral edges 18 and 20 being covered by a paper covering portion, for example, 22 shown in FIG. 3.

Only one panel member will be described, it being understood that in order to form the wall 2 of the invention, like panels are positioned in side-by-side relationship. Thus, for example, in the figures, it will be noted that two panel members 4 are shown in abutting relationship and the juncture line 25, (FIG. 1), is formed by reason of one panel 4 having a formed lateral edge 20 abut an opposed formed lateral edge 24 of the adjacently positioned panel 4, best seen in FIG. 3.

Figure 3:
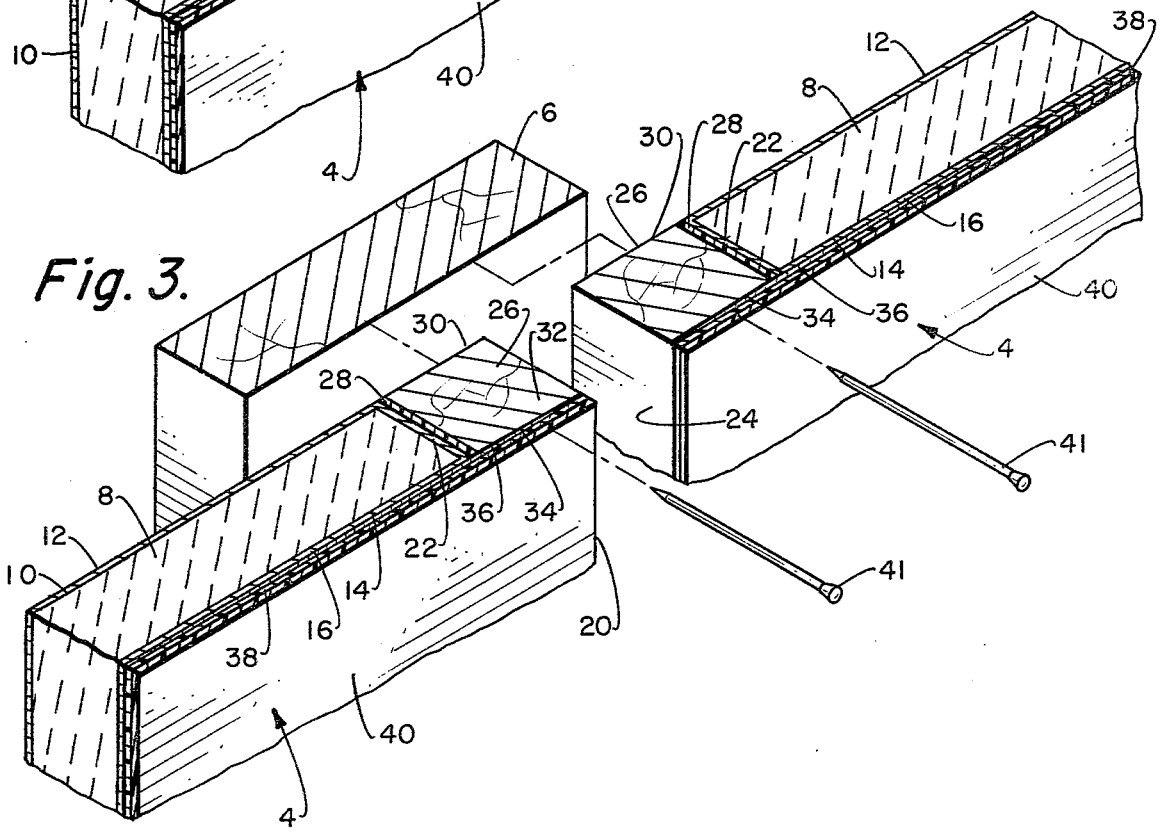
FIG. 3 is an exploded view of the showing of FIG. 2 to better illustrate the specific details of the invention.

Lateral edge 20 of panel 4, illustrated in FIG. 3, has secured thereto lateral edge member 26 in this instance of wood, extending the entire length of the gypsum core member 8 and being heat sealingly secured by means of adhesive layer 28.

It is to be understood that the opposite lateral edge also has a lateral edge member similarly applied, as lateral edge member 26 is applied to the edge 22.

Figure 4:
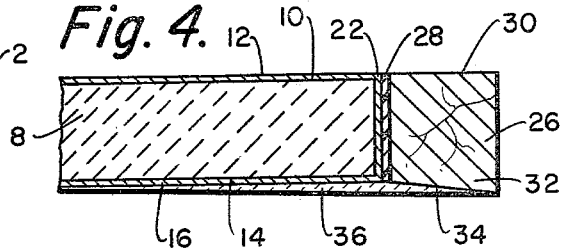
FIG. 4 illustrates, in enlarged form, the first step in making one type of lateral edge of the panels of this invention as illustrated in FIG. 5.

FIG. 4 illustrates the first starting point in fabrication of and in finishing the edges of a panel 4, one edge, only, being illustrated. The gypsum core member 8, has secured to the edge 22, by means of adhesive layer 28, wedge-shaped, wood, extending, lateral edge member 26. Lateral edge member 26 is about ⅝" wide so as to receive securement means, as will become apparent. The one surface formed by the paper layer 12 on the surface 10 of gypsum core member 8. The opposed surface 32 is outwardly flaring and exteriorly presented as shown in FIG. 4. The angle formed with regard to horizontal of the outwardly exteriorly presented surface is about 20°–25°.

Figure 5:
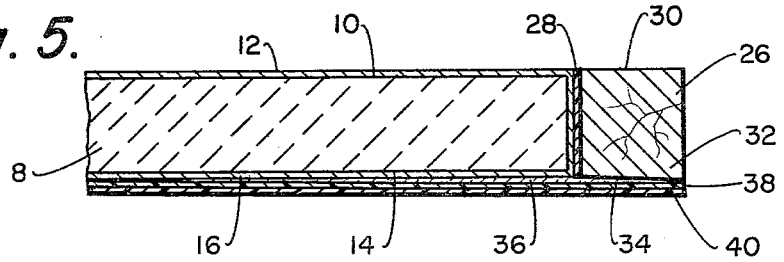
FIG. 5 illustrates the finished panel of the invention depicted in FIGS. 2 and 3.

The recess thusly formed between the flaring surface 34 and the surface formed by the paper covering 16 of core member 8 is filled in with filler or spackle 36 and feathered so as to provide substantial continuity of a planar nature with paper covering 16. The fill in layer 36 may be any type of noncombustible filler of the vermiculite type or may be a spackle that is commonly used in the building industry. It is only important that the filler be feathered onto the surface formed by the paper covering 16 on the surface 14 of gypsum core 8 so that a flash or planar appearance is obtained. The assemblage of FIG. 4 is then subjected to a planing or sanding procedure in order to make the exteriorly facing surface planar. This requires sanding off the flared edge 32 and spackle or filler layer 36 to an almost normal or perpendicular configuration as shown in FIG. 5.

The panel 4 may now have applied to it a decorative coating. In this particular instance, an adhesive layer 38 is applied to the remaining filler 36 and the paper covering 16 and laminated thereto is wall covering, such as layer 40, which may be texturized vinyl or the like. In order to complete the prefabrication of the predecorated or prefinished panel, the individual panels 4 are put through a sawing or squaring operation so as to insure that the lateral edges 18 and 20, for example, are as square as possible within minimum tolerances so that when the panels 4 are placed in side-by-side abutting relationship, a barely discernible juncture or seam 25 is formed.

Figure 6:
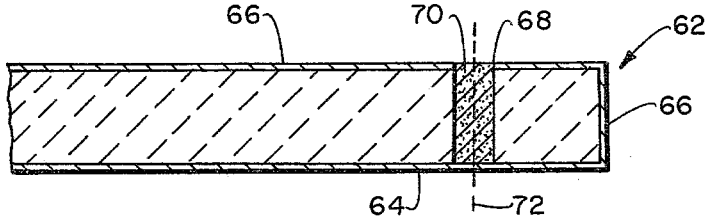
FIG. 6 illustrates one step in the process of producing FIG. 8 embodiment of the invention.
Figure 7:
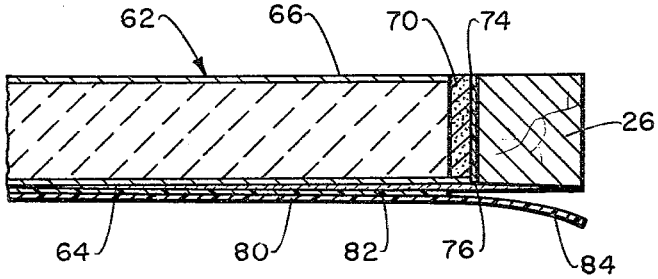
FIG. 7 illustrates the finished panel used in the FIG. 8 embodiment of the invention.
Figure 8:
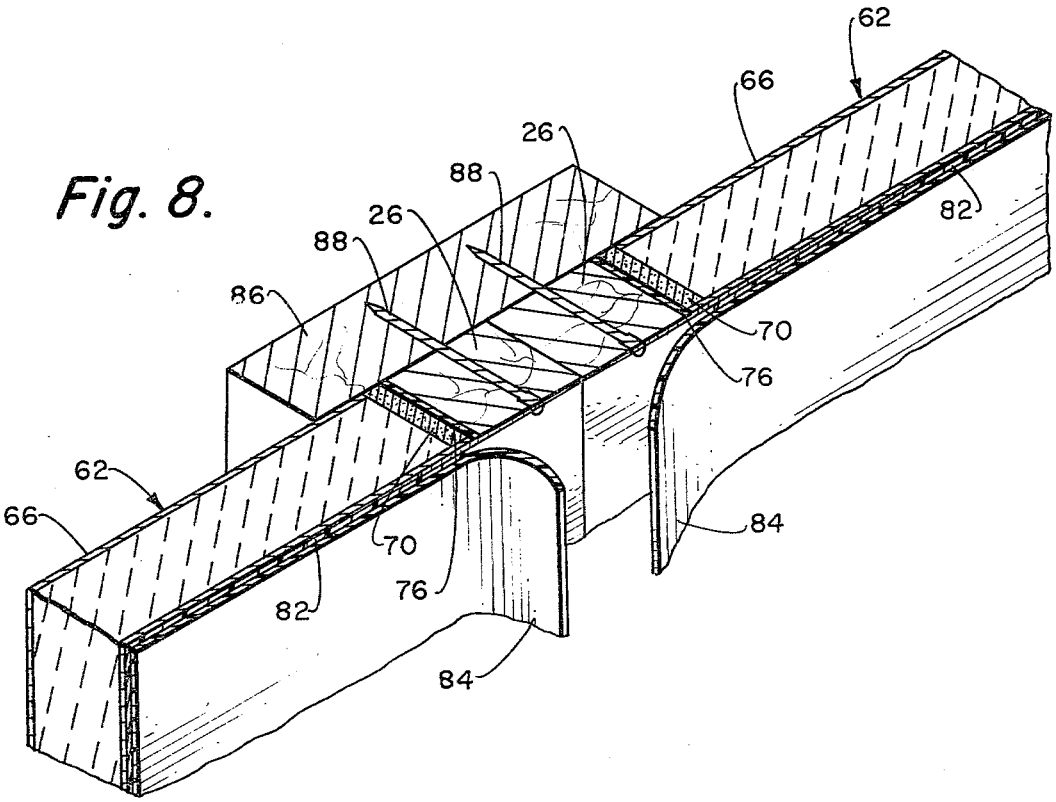
FIG. 8 illustrates another embodiment of the invention.

Referring now to FIGS. 6, 7 and 8 and an alternative form of the invention is depicted. In the instance where it is not possible to obtain a gypsum core panel having the desired size, configuration and trueness or squareness of lateral edges and wherein the gypsum is not paper covered so as to accommodate gluing, for example, of lateral wood edge member 26 thereto, a conventional gypsum board panel is used. Such panel 62 having surfaces 64 and 66, which are paper covered, as well as opposed lateral edges (one lateral edge 66 being shown), is prepared in order to receive lateral wood edge member 26. In this particular instance, one side of the gypsum panel 62 is subjected to a sawing operation approximately ½" inwards from the lateral edges, and, in particular, the lateral edge 66, as shown. The saw produces a groove 68 extending through the thickness of the gypsum board panel 62 to about the paper layer, making up the surface 64. The groove 68 is thereafter filled in with a filler such as "PATCHWOOD" or similar such filler, the PATCHWOOD being manufactured by the 3-M Company.

The filler 70 fills the entire groove 68 along the entire length of the panel 62. It should be understood that only one lateral edge of the panel is so treated, so as to eventually obtain a panel 48 inches in width.

The width of the groove 68 is approximately ⅛" and the panel 62, after the filled groove is solidified, is thereafter subjected to a cutting process so that the filler layer 70 is cut down the approximate center, represented by the line 72, disregarding the cutoff portion of the filler and gypsum edge, thereby producing a new edge 74, which in reality is the remainder of filler layer 70 adhered to the gypsum core of panel 62. The exposed edge 74 provides means whereby the wood edge member 26 may be adhesively secured to the panel 62 by means of, for example, adhesive layer 76. The procedure and process just described may also be substitutive of the previously described process of adhering the wood edge member 26 to the gypsum panel 4, which has paper-covered lateral edges. Because the proper sized gypsum panel may not be available, the immediately aforedescribed procedure produces a squared and 48 inch wide panel member for the practice of the invention.

The thusly prepared panel 62 is then subjected to the similar process described for the panel 4 and, in particular, the FIG. 4 representation with regard to the filling in of the one surface of the panel with a spackle filler or the like.

In the FIGS. 6–8 embodiment, the practice of the invention is identical as described for the foregoing, with the exception that the individual panels 62 are prefinished at the factory site to the extent of the application of, for example, a texturized or other type of vinyl wall covering, for example, 80. Covering 80 is adhered to the surface 64 by means of adhesive layer 82, leaving flap portions 84 unsecured until the panel is positioned and nailed to supporting studs 86 by means of nail 88. Afterwards, adhesive is provided on the under surface of the flaps 84 and rolled or otherwise put into flush engagement with the remainder of the vinyl wall covering 80 to thereby form a finished wall.

Figure 2:
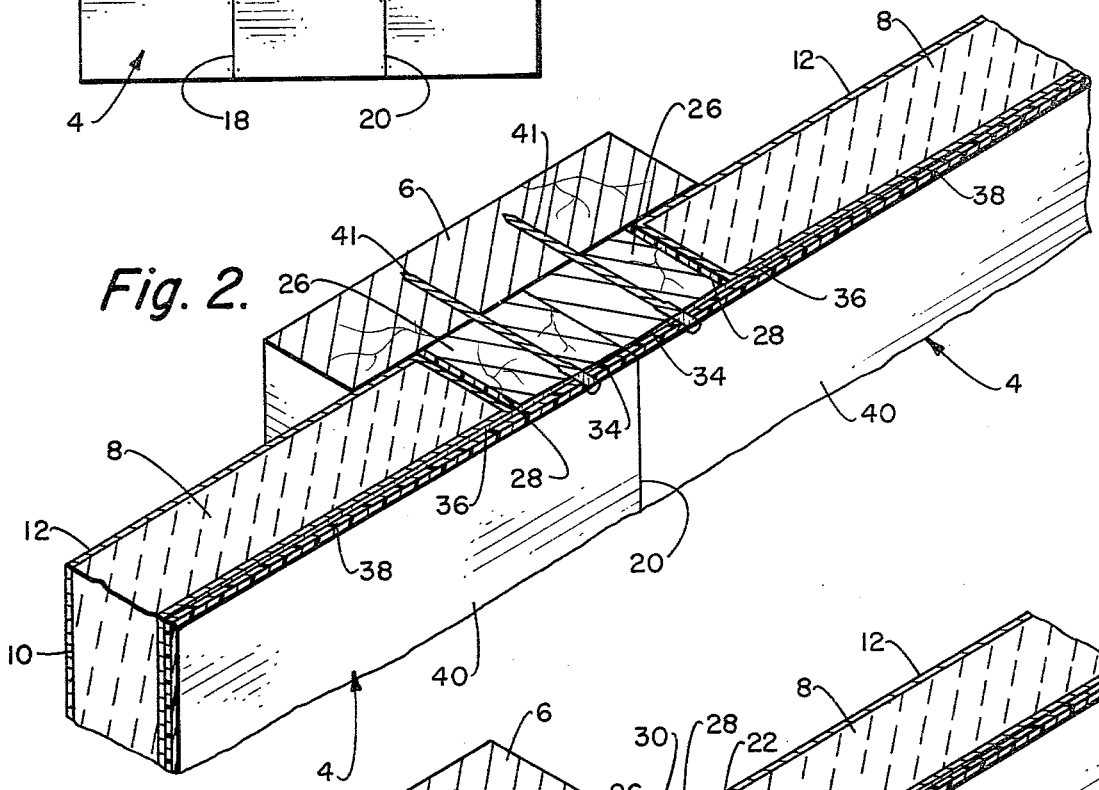
FIG. 2 is a view taken along the line 2—2 enlarged for purposes of clarity.

The individual prefinished or predecorated panels 4 or 62 are then shipped to the job site, where they are vertically positioned and nailed in place by means of nails 41 being driven through the lateral edge members 26 into the supporting structure. Then, depending on the embodiment of the invention and, depending upon the type of decorative coating or surface applied to the individual panels, the nail holes are filled with like material as is applied to the remaining surface of the panels or the loose flaps of the decorative layer are secured over the driven nails holding the individual panels to the underlying supporting stud. In the FIG. 2 embodiment, a finely divided mixture of the texturized wall covering 40 may be mixed with adhesive and carefully applied in the unfilled hole formed by the nail 41.

The finished wall, using any of the disclosed embodiments, is aesthetic in appearance and forms a butt seam which is barely discernible, not requiring extensive procedures utilized in dry-wall construction per se, wherein nails, seam tape and spackle finish must be applied to cover the butt seam and thereafter a decorative surface or layer applied.

Thus, there has been described and illustrated wall panel construction which is prefinished at the factory site and which is easily and economically erectable into interior walls or partitions of at least Class A fire resistive characteristic. The panels are easily handled and easily erected by ordinarily skilled workmen not requiring the sophisticated skills of a carpenter or the like. While the invention has been described with particularity with regard to details of construction and materials thereof, those of ordinary skill in the art will at once recognize that modifications and alterations may be made, all without departing from the spirit and scope of the invention and all such changes, alterations and modifications are intended to be covered by the appended claims.

I claim:

1. A panel construction for interior walls comprising a gypsum core having opposed lateral edges intended for about vertical disposition to form a portion of an interior wall, said core member having opposed planar surfaces, one of said surfaces being adapted to be aesthetically and exteriorly finished, the other being unfinished; an elongate, wood, edge member secured in adjacent relationship to each of the opposed lateral edges with a hot melt adhesive layer and extending about the extent thereof and having one surface having about planar continuity with said unfinished surface, the other surface being planar and angularly flaring outwardly and exteriorly of the plane of said surface adapted to be aesthetically and exteriorly finished, said member being of sufficient width to accommodate securement means therethrough; and a layer of filler extending from the edge of said elongate edge member and feathered to fill in and provide continuity between said one of said surfaces adapted to be aesthetically and exteriorly finished and said other surface facing outwardly and exteriorly of said elongate edge member, said surfaces and lateral edges of said gypsum core member having a paper covering thereon.

* * * * *